US006345407B1

(12) United States Patent
Jupp

(10) Patent No.: US 6,345,407 B1
(45) Date of Patent: Feb. 12, 2002

(54) TOOL HOLDER FOR A VACUUM CLEANER OR OTHER CLEANING APPLIANCE

(75) Inventor: Simeon Charles Jupp, Wiltshire (GB)

(73) Assignee: Notetry Limited, Wiltshire (GB)

( * ) Notice: Subject to any disclaimer, the term of this patent is extended or adjusted under 35 U.S.C. 154(b) by 0 days.

(21) Appl. No.: 09/674,843

(22) PCT Filed: Apr. 30, 1999

(86) PCT No.: PCT/GB99/01369

§ 371 Date: Jan. 2, 2001

§ 102(e) Date: Jan. 2, 2001

(87) PCT Pub. No.: WO99/56609

PCT Pub. Date: Nov. 11, 1999

(30) Foreign Application Priority Data

May 7, 1998 (GB) ..... 9809837

(51) Int. Cl.[7] ..... A47L 9/00
(52) U.S. Cl. ..... 15/323
(58) Field of Search ..... 15/323, 339

(56) References Cited

U.S. PATENT DOCUMENTS

| | | | | | |
|---|---|---|---|---|---|
| 1,354,710 | A | | 10/1920 | Wise | |
| 3,220,041 | A | * | 11/1965 | Jepson et al. | 15/323 |
| 3,872,538 | A | | 3/1975 | Crouser | |
| 4,563,789 | A | | 1/1986 | Berfield | |
| 4,761,850 | A | | 8/1988 | Romeo et al. | |
| 5,307,537 | A | * | 5/1994 | Essex et al. | 15/323 |
| 5,732,438 | A | * | 3/1998 | Tuvin et al. | 15/323 |
| 5,826,299 | A | * | 10/1998 | Kim | 15/323 |
| 6,058,558 | A | * | 5/2000 | Kim | 15/323 |
| 6,098,241 | A | | 8/2000 | Wood | |

FOREIGN PATENT DOCUMENTS

| | | | | |
|---|---|---|---|---|
| AU | 13656 | * | 7/1934 | 15/323 |

* cited by examiner

*Primary Examiner*—Chris K. Moore
(74) *Attorney, Agent, or Firm*—Morrison & Foerster LLP

(57) ABSTRACT

The invention provides a tool holder for a vacuum cleaner having a main body, a wand and a hose therebetween, the tool holder (10) comprising attachment means (12, 14) for attaching the tool holder (10) to the vacuum cleaner and tool receiving means (22) for receiving at least one tool (30, 32, 34), wherein the attachment means (12, 14) are adapted such that the tool holder (10) is attachable directly to the hose (16) at any point between the main body and the wand.

19 Claims, 2 Drawing Sheets

Fig. 1.
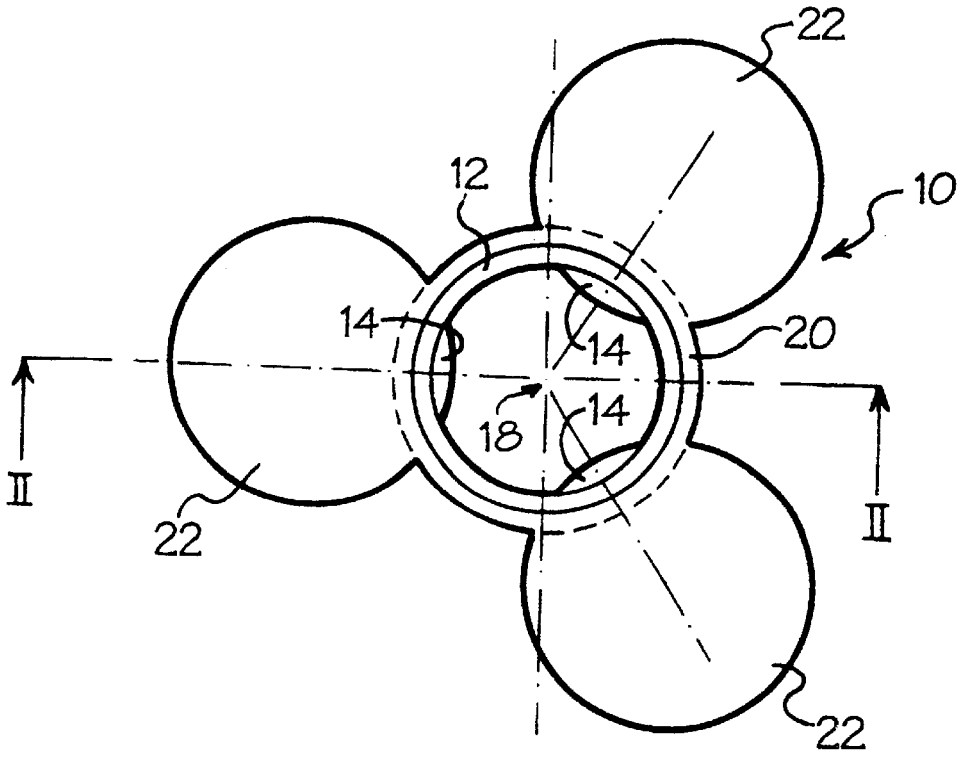
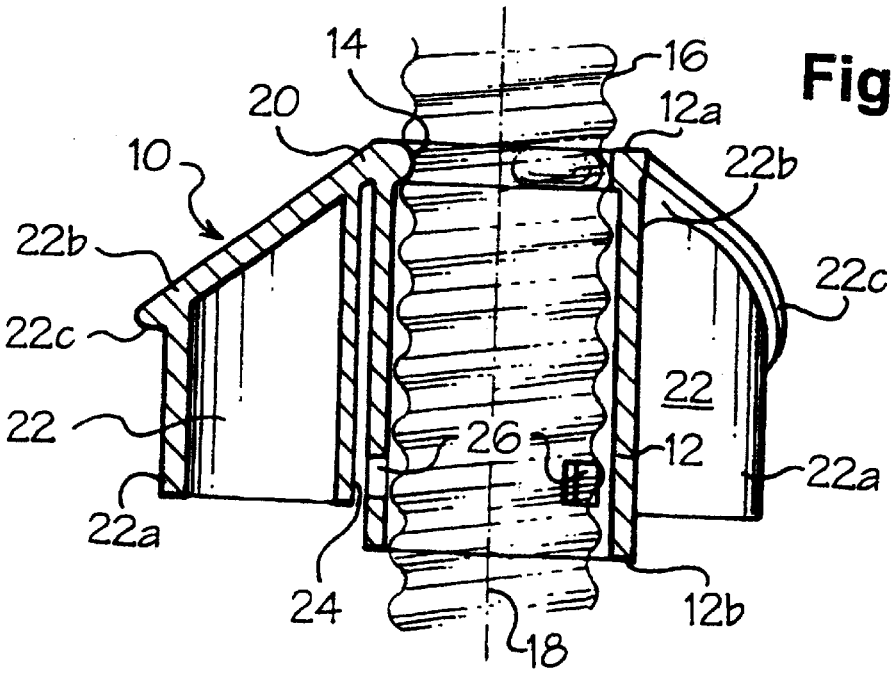
Fig. 2.

TOOL HOLDER FOR A VACUUM CLEANER OR OTHER CLEANING APPLIANCE

FIELD OF THE INVENTION

The invention relates to a tool holder for a vacuum cleaner or other cleaning appliance.

BACKGROUND OF THE INVENTION

Many vacuum cleaners operate in the cylinder mode, that is to say that the dirty air inlet is located at the end of a wand which is connected to the main body of the vacuum cleaner by a flexible hose. Dirty air is drawn into the dirty air inlet by means of a fan driven by a motor, both of which are located in the main body of the vacuum cleaner. The dirty air inlet is normally formed by a cleaner head, but there are times when the cleaner head is inappropriate and the user of the vacuum cleaner requires to replace the cleaner head with a tool more appropriate to the type of cleaning being carried out. The most common types of tool are a brush tool (incorporating a ring of bristles surrounding a suction inlet), a crevice tool (comprising a slim, elongate suction pipe suitable for providing access into comers and other places difficult to access) and a stair tool (consisting of an angled inlet suitable for use on stairs). In many cases, these tools are carried on the main body of the cleaner itself. This can be inconvenient for the user, particularly when the user is elderly or disabled. It would be more convenient to locate the tools more readily to hand.

Various proposals have been made in which the tools for a vacuum cleaner are carried by a tool holder in the vicinity of the portion of the wand or hose normally gripped by the user during use. One such proposal is set out in European Patent Application No EP 0 747 000A. However, the device disclosed in this publication has several disadvantages. Firstly, the tools are stored directly on the handle which makes the handle bulky and unwieldy. Secondly, each of the tools must be placed in a specially shaped recess and therefore care must be taken to ensure that each tool is correctly placed. The construction is inconvenient and can be expensive to add to an existing vacuum cleaner. Because of the fixed position of each tool with respect to the handle, one or more of the tools is also less readily accessible by a user than others.

Another proposal for carrying tools on a vacuum cleaner is set out in UK Patent No 1 460 119. In this document, a dedicated tool carrier is designed to be affixed to the fitting which connects the hose to the main body of the vacuum cleaner. Because the tools are carried so close to the main body, there is no advantage over other pieces of prior art in that the user of the vacuum cleaner must make a considerable effort to locate the correct tool before attaching it to the wand for appropriate use. An arrangement for retaining the free end of the hose of a vacuum cleaner is disclosed in U.S. Pat. No. 4,563,789.

None of the prior art proposes a tool holder for holding the tools on a vacuum cleaner which can be positioned at a convenient point away from the portion of the wand normally gripped by the user but still in a convenient location. Furthermore, none of the prior art discloses a tool holder which can be positioned at one of a number of locations so that the tools are convenient to any specific user.

It is therefore an object of the present invention to provide a tool holder for a vacuum cleaner which overcomes the disadvantages specified above. It is a further object of the present invention to provide a tool holder which is more versatile and able to be adapted to the needs of individual users. A further object of the invention is to provide a tool holder to which tools can be easily attached and from which tools can be easily released.

A SUMMARY OF THE INVENTION

The invention provides a tool holder for a vacuum cleaner or other cleaning appliance according to Claim 1. The ability of the tool holder to be attached directly to a flexible portion of the hose at any point between the main body and the wand allows the tool to be positioned more conveniently for any one user. Preferably, the tool can be positioned at any one of a number of points between the main body and the wand. This allows the user complete control over the position of the tool holder along the hose. Thus any user can position the tool holder according to their individual requirements. Furthermore, if desired, more than one such tool holder can be located on the hose so that a large number of tools can be carried ready for use by the user of the vacuum cleaner.

Preferably, the tool receiving means comprise at least one peg or socket for slidably receiving the tool and further retaining means for retaining a tool on or in each of the at least one peg or socket in a snap-fit manner. This provides a simple construction which is easy to use and which does not require further tools or awkward manipulations to release the tool from the tool holder. The simple tongue and groove arrangement of the retaining means is a particularly simple and effective arrangement. Further preferable and advantageous features are set out in the subsidiary claims.

BRIEF DESCRIPTION OF THE DRAWINGS

An embodiment of a tool holder according to the invention will now be described in detail by way of example only and with reference to the accompanying drawings, wherein:

FIG. 1 is a plan view of a tool holder for a vacuum cleaner according to the invention;

FIG. 2 is a cross sectional view taken on line II—II of FIG. 1 and showing the position of the tool holder with respect to a hose of a vacuum cleaner;

DETAILED DESCRIPTION OF THE INVENTION

Figure 3:
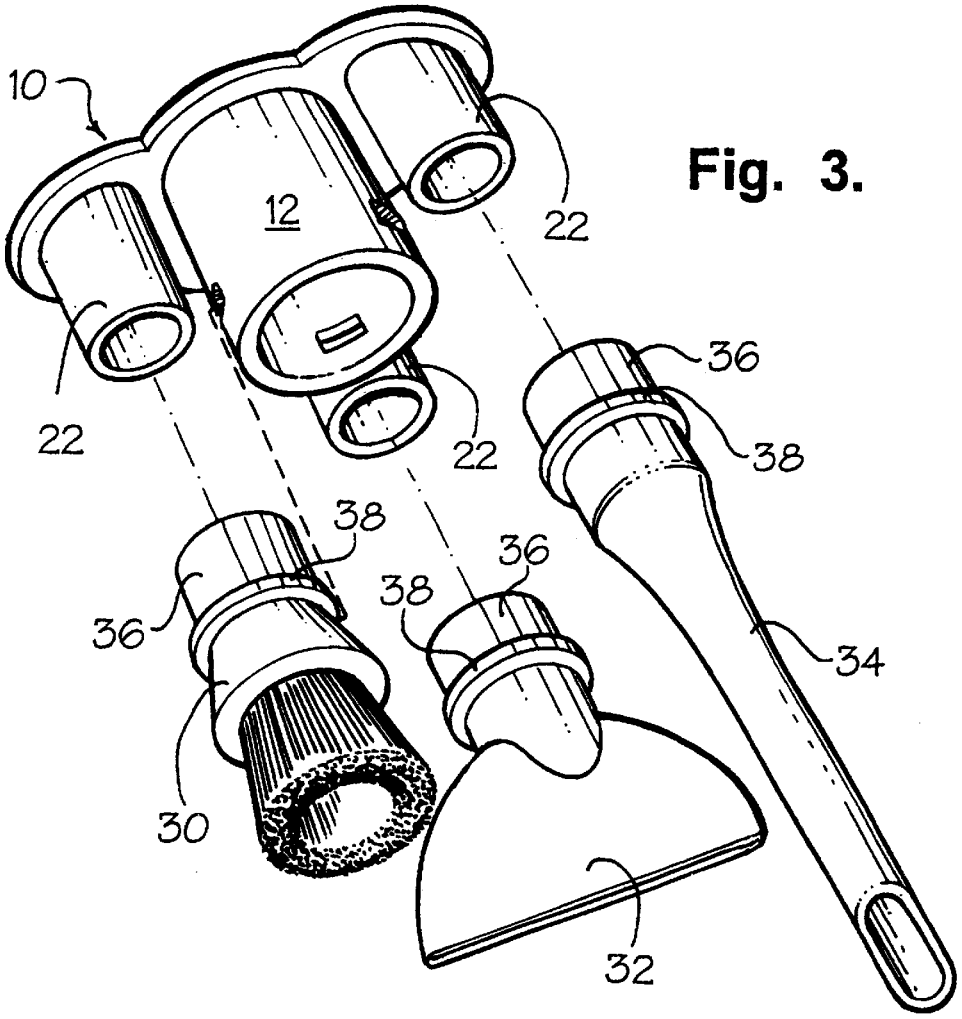
FIG. 3 is a perspective view of the tool holder of FIGS. 1 and 2 illustrating a method of attachment of a variety of tools.

The tool holder 10 shown in FIGS. 1 and 2 comprises a central cylindrical sleeve 12. The cylindrical sleeve 12 is open at its upper end 12*a* and at its lower end 12*b*. Three equispaced projections 14 extend inwardly just inside the open upper end 12*a* of the cylindrical sleeve 12. Each projection 14 has a smooth contour although it is generally triangular in cross section with a rounded inner edge (see FIG. 2). Each projection 14 could alternatively be semi-elliptical or semi-circular in cross section.

The inner diameter of the cylindrical sleeve 12 along the majority of its length is a little greater than the outer diameter of the hose 16 of the vacuum cleaner to which the tool holder 10 is to be attached. A typical hose diameter is 40–50 mm. The internal diameter of the sleeve 12 along the majority of its length is between 2 mm and 10 mm greater than the diameter of the hose 16. The projections 14 extend radially inwardly towards the longitudinal axis 18 of the tool holder 10 such that, when the tool holder 10 is located on the hose 16, the projections 14 project radially inwardly between the convolutions of the telescopic hose 16. The projections 14 thus engage with the hose and prevent the tool holder 10 from moving axially along the hose 16.

However, the projections 14 are dimensioned so as to allow the hose 16 to be pulled through the cylindrical sleeve 12 if desired. The user of the vacuum cleaner may grasp the hose 16 and apply a moderate force so as to allow the hose 16 to distort and slip past the projections 14. In this way, the tool holder 10 can be positioned on the hose 16 at any required point between the wand the main body containing the motor and the fan. The projections 14 shown in FIGS. 1 and 2 lie on an annular path.

In an alternative embodiment, the projections can be located so that they lie on a helical path. The helical path is then adapted to coincide with one complete turn of the convolutions of the hose. This reduces distortion of the hose when the tool holder is located on the hose. In order to adjust the position of the tool holder, either the hose can be pulled through the tool holder as described above or, alternatively, the tool holder can be rotated about the longitudinal axis of the hose in order to "screw" the tool holder along the hose.

At the upper end 12*a* of the tool holder 10 shown in FIGS. 1 and 2, an annular web 20 extends radially outwardly from the cylindrical sleeve 12. Equispaced about the axis 18 and attached to the annular web 20 are three tool-receiving pegs or spigots 22. Each peg or spigot 22 consists of a cylindrical member 22*a* closed at its upper end by an inclined base 22*b*. The inclined base 22*b* extends radially outwardly beyond the cylindrical member 22*a* in the manner of a lip 22*c*. Each peg or spigot 22 is spaced from the cylindrical sleeve 12 so that a gap is formed between the cylindrical sleeve 12 and the cylindrical member 22*a*. The purpose of the gap 24 will be described below. Three recesses or apertures 26 are formed in the cylindrical sleeve 12 at the points at which the cylindrical sleeve 12 approaches each peg or spigot 22. Again, the purpose of these recesses or apertures 26 will be explained below.

FIG. 3 illustrates the manner in which the tool holder 10 is able to receive a plurality of tools 30,32,34. In the illustration, tool 30 is a brush tool, tool 32 is a stair tool, and tool 34 is a crevice tool. In each case, the tool 30,32,34 has an open cylindrical socket 36 by means of which the tool 30,32,34 can be attached to the remote end of the wand of the vacuum cleaner for cleaning purposes. The dimensions of the socket 36 are therefore dictated by the dimensions of the end of the wand of the vacuum cleaner. An annular tongue 38 extends around each socket 36 and projects radially outwardly therefrom. The annular tongue 38 is spaced from the open end of the socket 36 in each case. The annular tongue 38 is made slightly resilient.

In order to locate one of the tools 30,32,34 on to the tool holder 10, the socket 36 is introduced over one of the pegs or spigots 22. The socket 36 is received into the gap 24 between the cylindrical member 22*a* of the peg or spigot 22 and the cylindrical sleeve 12. The size of the gap 24 must be sufficient to allow this to happen and is therefore dependent upon the thickness of the wall of the socket 36. The open end of the socket 36 slides over the peg or spigot 22 until it abuts against the lip 22*c* of the inclined base 22*b*. Further sliding movement of the tool 30,32,34 with respect to the peg or spigot 22 is thereby prevented. The position of the annular tongue 38 with respect to the open end of the socket 36 is such that the annular tongue 38 projects into the recess or aperture 26 in the cylindrical sleeve 12 when t he open end of the socket 36 abuts against the lip 22*c*. The size of the gap 24 is therefore also dependent upon the dimensions of the annular tongue 38. The resilient nature of the annular tongue 38 allows a snap-fit co-operation between the annular tongue 38 and the recess or aperture 26. As soon as the annular tongue 38 has been located in the recess or aperture 26, the tool 30,32,34 is prevented from sliding freely off the peg or spigot 22. The tool 30,32,34 is thereby held securely until the user of the vacuum cleaner requires to remove the tool 30,32,34 from the tool holder 10. Moderate pulling of the tool 30,32,34 in a direction parallel to the longitudinal axis 18 will cause deformation of the annular tongue 38 which then releases itself from the recess or aperture 26 and allows the tool 30,32,34 to be slid off the peg or spigot 22. Until this happens, the tool 30,32,34 is firmly held on the tool holder 10.

Each of the tools 30,32,34 incorporates a socket 36 and annular tongue 38. Since the pegs or spigots 22 and the recesses or apertures 26 are identically formed in each case, any one of the tools 30,32,34 can be simply and easily located on the tool holder 10 in any one of a number of positions. In the embodiment shown, three pegs or spigots are provided. It will be appreciated that a different number of pegs or spigots can be provided if desired. It will also be appreciated that the exact configuration of the means which retain the tools 30,32,34 on the tool holder can be varied; for example, the cylindrical sleeve 12 could carry an annular projection instead of recesses or apertures, whilst each tool 30,32,34 could incorporate recesses or apertures. The effect would be exactly the same. It will be appreciated that a similar effect can be achieved by the peg or spigot 22 being made slightly resilient in the area of the annular web 30 so that each peg or spigot 22 can be moved away from the cylindrical sleeve 12 sufficiently far to allow the annular tongue 38 to be introduced to or removed from the recess or aperture 26. In this case, the annular tongue 38 need not be resilient.

Figure 4:
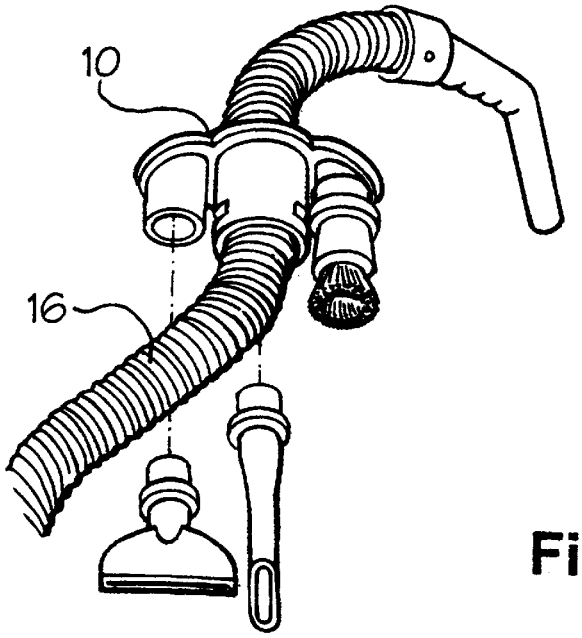
FIG. 4 illustrates a possible position of the tool holder of FIGS. 1 to 3 on the hose of a vacuum cleaner when in use.

As can be seen from FIG. 4, the tool holder 10 can be attached to the hose of a vacuum cleaner and tools conveniently stored thereon at any position convenient for the individual user. Furthermore, moderate pulling of the hose 16 or "screwing" of the tool holder 10 about the hose 16 causes the position of the tool holder 10 to be adjusted at will. This means that the individual user of the vacuum cleaner can ensure that the tool holder is positioned conveniently for their own needs. The identity of each tool receiving means avoids the need to inspect the tool. holder before introducing any one tool to the holder since any of the tools can be held and retained by any one of the tool receiving means.

It will also be appreciated that more than one tool holder 10 can be mounted on the hose 16 of any vacuum cleaner. In the event that the number of tools commonly used by an individual user of the vacuum cleaner exceeds the number of tools capable of being retained by a single tool holder, a second, or even a third, tool holder can be introduced. The tool holder 10 would normally be introduced to the hose by detaching the hose from the main body of the cleaner and merely sliding the end of the hose through the cylindrical sleeve 12. The application of a moderate force or screwing action will bring the tool holder 10 to the desired position. The tool holder 10 will be positioned taking account of any further tool holders which might need to be introduced to the hose.

Conveniently, the tool holder 10 is manufactured from a lightweight plastics material by injection moulding. Manufacturing the tool holder from a heavy material would, of course, add to the weight to be carried by the user and may in some cases detract from the maneuverability if the vacuum cleaner wand. However, the tool holder 10 must be of sufficient strength to withstand being carried by the vacuum cleaner hose during normal use of the vacuum cleaner, and also being stored when the vacuum cleaner is not in use.

The invention is not intended to be limited to the precise features of the embodiment described above. Various modifications and alternatives will be apparent to a skilled reader. Specifically, it is recognized that, whilst the specific embodiment described above relates to a vacuum cleaner, there are other cleaning appliances which utilize tools and incorporate hoses and this invention is as applicable to these appliances as to vacuum cleaners.

What is claimed is:

1. A tool holder for a vacuum cleaner or other cleaning appliance having a main body, a wand, a hose extending therebetween and at least one tool removably attachable to the end of the wand remote from the hose, the tool holder comprising attachment means for attaching the tool holder to the vacuum cleaner and tool-receiving means for receiving at least one tool, wherein the attachment means are adapted such that the tool holder is attachable directly to a flexible portion of the hose at a point between the main body and the wand.

2. A tool holder as claimed in claim 1, wherein the tool holder is attachable to the hose at any one of a number of points between the main body and the wand.

3. A tool holder as claimed in claim 1, wherein the attachment means comprise a cylindrical sleeve for surrounding a portion of the hose and at least one inwardly extending projection for locating between adjacent ribs of the hose.

4. A tool holder as claimed in claim 3, wherein a plurality of equispaced projections are provided.

5. A tool holder as claimed in claim 4, wherein the projections are located on a helical path.

6. A tool holder as claimed in claim 5, wherein the convolutions of the hose are helical and the tool holder can be moved along the hose by rotation about the longitudinal axis of the hose.

7. A tool holder as claimed in claim 4, wherein the projections are located on an annular path.

8. A tool holder as claimed in claim 3, wherein the or each projection is adapted or dimensioned so as to allow the hose to be pulled through the cylindrical sleeve on application of a moderate force to the hose, and to prevent such relative movement on release of the said moderate force.

9. A tool holder as claimed in claim 1, wherein the tool-receiving means comprise at least one peg or socket for slidably receiving a tool, and retaining means for retaining a tool on or in each of the at least one peg or socket in a snap-fit manner.

10. A tool holder as claimed in claim 9, wherein the retaining means comprise a groove or tongue for receiving a corresponding tongue or groove formed on the respective tool.

11. A tool holder as claims in claim 1, wherein the attachment means comprise a cylindrical sleeve for surrounding a portion of the hose and the retaining means are located on the cylindrical sleeve.

12. A tool holder as claimed in claim 1, wherein at least one tool is received by the tool-receiving means, the or each tool extends generally parallel to and alongside the hose.

13. A tool holder as claimed in claim 1, wherein the tool-receiving means are capable of receiving a plurality of tools.

14. A tool holder as claimed in claim 13, wherein the tool-receiving means are capable of receiving three tools.

15. A tool holder as claimed in claim 13, wherein when in use the tools are received by the tool-receiving means, the tools are equispaced about the hose.

16. A tool holder as claimed in claim 13, wherein the tool-receiving means for receiving each tool are identical so as to allow any one tool to be received in any one of a plurality of different positions.

17. A vacuum cleaner having a main body, a wand and a hose therebetween, further comprising a tool holder according to claim 1 attached to the hose thereof.

18. A vacuum cleaner as claimed in claim 17, further comprising at least one tool, wherein the or each tool has a cylindrical sleeve receivable by the tool-receiving means of the tool holder and an annular tongue extending around the circumference of the cylindrical sleeve.

19. A vacuum cleaner having a main body, a wand and a hose therebetween, farther comprising a plurality of tool holders according to claim 1 attached to the hose thereof.

* * * * *